United States Patent [19]

Parrotta et al.

[11] Patent Number: 5,072,831

[45] Date of Patent: Dec. 17, 1991

[54] RUB-OFF ADVERTISING SAMPLER AND METHOD OF MANUFACTURE

[75] Inventors: Michael A. Parrotta, Hamilton Square; Frederick Grainger, West Greenbrook; Donald Schoenleber, Bellemead, all of N.J.

[73] Assignee: Webcraft Technologies, Inc., North Brunswick, N.J.

[21] Appl. No.: 170,624

[22] Filed: Mar. 17, 1988

Related U.S. Application Data

[63] Continuation of Ser. No. 721,769, Apr. 10, 1985, abandoned.

[51] Int. Cl.[5] ..... A45D 40/22

[52] U.S. Cl. ..... 206/232; 132/333; 206/459; 206/823; 283/56

[58] Field of Search ..... 132/317, 320, 333; 156/278, 279; 206/232, 233, 581, 823, 447, 459; 229/928; 283/1, 56, 62, 100; 427/261, 265; 428/166, 172, 905

[56] References Cited

U.S. PATENT DOCUMENTS

| | | | |
|---|---|---|---|
| 1,687,643 | 10/1927 | Berliner | 206/233 X |
| 1,743,512 | 1/1930 | Aisen | 132/79 D |
| 1,885,076 | 10/1932 | Bustamante | 132/79 D |
| 1,888,314 | 11/1932 | Framke | 132/79 D |
| 2,061,139 | 11/1936 | Cohen | 206/538 X |
| 2,175,133 | 10/1939 | Singleton | 206/823 |
| 2,185,386 | 1/1940 | Valentine | 206/823 |
| 2,557,141 | 6/1951 | Rebora | 206/235 X |
| 2,561,400 | 4/1951 | Morrell | 132/79 |
| 2,606,565 | 8/1952 | Sage, Sr. | 132/320 |
| 2,717,174 | 8/1951 | Casanova | 229/92.8 X |
| 3,691,270 | 9/1972 | Charle et al. | 132/88.7 X |
| 4,890,872 | 1/1990 | Parrotta et al. | 206/823 |

FOREIGN PATENT DOCUMENTS

| | | | |
|---|---|---|---|
| 3016573 | 11/1981 | Fed. Rep. of Germany | 283/56 |
| 1329309 | 9/1973 | United Kingdom | 428/905 X |

OTHER PUBLICATIONS

Sagarin, E.: Cosmetics Science and Technology, Interscience, New York, 1957, pp. 286–295.

Givenchy ad, in PTO 283/56.

*Primary Examiner*—Jimmy G. Foster

*Attorney, Agent, or Firm*—Shlesinger Arkwright & Garvey

[57] ABSTRACT

The advertising sampler provides a transfer layer material which is removable by finger tip and spreadable on the skin. The sampler includes a paper stock having printing thereon referring to the transfer layer sample. An oil-impervious barrier layer is located between the transfer layer and the paper stock to prevent bleed-through, and a removable protective covering sheet is positionable over the transfer layer to protect the transfer layer.

10 Claims, 1 Drawing Sheet

RUB-OFF ADVERTISING SAMPLER AND METHOD OF MANUFACTURE

This application is a continuation of application Ser. No. 721,769, filed 4/10/85, now abandoned.

BACKGROUND OF THE INVENTION

This invention relates to low cost mass produced advertising pieces, and particularly to an advertising sampler having a removable layer for demonstrating the product advertised in the sample. It has particular application to low cost samplers used for promoting the sale of cosmetics.

Such samplers must be produced inexpensively so that a low unit cost is incurred by the advertiser wishing to reach a large mass market. Heretofore, this has not been possible.

Actual cosmetic packets have been marketed in different package arrangements in the past, but these were not adaptable to high unit production techniques, nor were they suitable for mass sample advertising distribution.

Marketing packets, such as cosmetic containing packets are shown by the Singleton, Morrell, Berlinger, and Sage patents. The Singleton U.S. Pat. No. 2,175,133 has a cosmetic containing envelope in which the cosmetic samples are placed between several sets of spaced sheets or paper. The Morrell U.S. Pat. No. 2,561,400 shows a cosmetic packet which has a series of open cells in which the cosmetic material to be marketed is placed. The Berliner U.S. Pat. No. 1,687,643 discloses a multiple sheet packet between which cold cream product is placed. The Sage U.S. Pat. No. 2,606,965 discloses a cosmetic applicator for applying a cosmetic film to the lips.

These patents all disclose particular cosmetic package marketing arrangements in which the product itself is distributed to the customer. None of these arrangements are suitable for large volume, inexpensive production, and have no use as marketing advertising pieces.

Cosmetics have been advertised on a national basis in newspapers, magazines, single sheet advertisements, and direct mail advertising. However, it has not been possible to increase the effectiveness of such advertising by providing a sample. Because of the nature of the sample and the requirement for a simple flat piece which can readily be printed and distributed, it has not been possible to enhance the ordinary printed advertisement with a composition sample representative of the product. Accordingly, there is a need for a simple mass-produced sampler piece to provide substantially more effective advertising for cosmetics and similar types of products which have a large national market.

SUMMARY OF INVENTION

Accordingly, it is a principal object of this invention to provide a new type of advertising piece which contains a representative sample and can be inexpensively produced and distributed.

It is another feature of this invention to provide a cosmetic advertising sampler which substantially increases the sales advertising potential for cosmetics and similar types of products, in which the representative sample can be directly supplied to the potential purchaser for inspection.

It is also a feature of this invention to provide a new type of sampler advertisement which contains a coating representative of the advertised product which can readily be removed.

It is a further feature of this invention to provide a cosmetic sampler piece of extremely simple construction which can be arranged in many different types of advertising formats, and produced by web fabrication techniques.

It is a still further feature of this invention to provide a rub-off cosmetic advertising sample which is readily removable from the advertising piece and is readily applied to the skin for color comparison purposes.

It is a still further feature of this invention to provide a rub-off advertising sampler piece in which the sample contained therein provides an accurate color match to that of the cosmetic product advertised on the sample piece.

It is another feature of this invention to provide an advertising piece in which the composition of the sample layer is readily applied as a stage in a continuous web printing process, and is not susceptible to damage during distribution.

These and other features and advantages of the invention will become apparent from the following description and the drawings.

DESCRIPTION OF THE INVENTION

Figure 1:
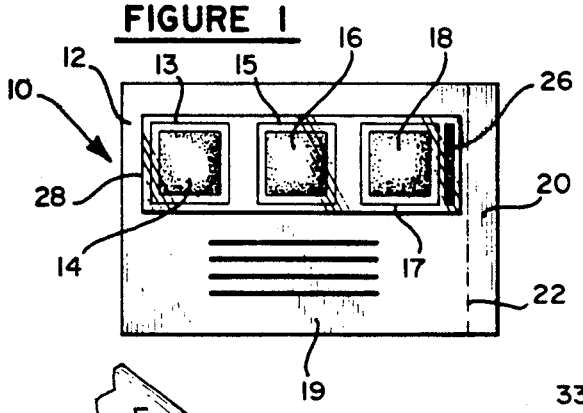
FIG. 1 is a view of a single sheet binder advertising sampler insert containing a plurality of rub-off samples.

Referring to the drawings, FIG. 1 shows an advertising cosmetic sampler piece generally indicated at 10. This is a flat sheet bind-in advertising cosmetic sampler which can be inserted in magazines and catalogues. It is a flat sheet which is printed, and then has advertising samples coated thereon. The advertising samples 14, 16 and 18 in this example are different color coatings representative of different colored advertising products which are readily removed by the recipient of the advertising piece. When paper stock is used with coatings of this type, which contain an oil or grease-like base, there is a problem of bleed-through encountered. To avoid this, the paper sheet material is initially coated with a barrier layer 13 15 and 17 before the sample layers 14, 16 and 18 are applied to the advertising piece. The barrier layers provide a smooth surface for receiving the sample layers, and also seal the somewhat porous surface of the paper sheet stock. These sample layers may also be described as transfer layers, since the user rubs off the coating and then simultaneously applies it to the skin area for color comparison.

The transfer or sample layers are a mixture of a cosmetic powder sample with a binder. The layers are applied as a thick viscous layer which subsequently hardens, to permit handling and distribution of the advertising pieces. The transfer layers resist smearing and damage, but are readily removable with mo light finger pressure. The sample transfer layers approximately to 10 thousandths of an inch in thickness.

The sample piece also contains advertising printing generally indicated at 19 which refers specifically to the samples 14, 16 and 18, which might be different colors or different textures of cosmetics; and these characteristics and comparisons are set forth in the printing material.

At the far end of the sheet 12 there is a binding strip 20 which is inserted in the binding area of the magazine or pamphlet to which the entire sample piece is to be attached. A perforated line 22 permits a cosmetic sample section of the advertising sample piece to be removed from the magazine or booklets by tearing along line 22.

The sample layers 14, 16 and 18 have a transparent protective covering strip 28 which is applied to sheet 12 and held in position by a glue strip 26. This is an optional feature of the advertising piece. It provides protection for each of the samples 14, 16 and 18 so that they reach the customer in an undamaged state. When the transfer sample layer is to be removed by the user, the strip 28 is lifted to provide access to the three sample areas.

Figure 2:
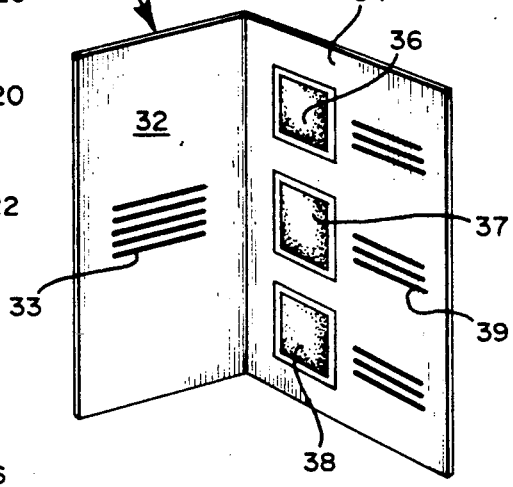
FIG. 2 is a perspective view of a pamphlet containing a plurality of rub-off samples.

Another type of sampler is shown in the perspective view of FIG. 2. This sampler pamphlet, generally indicated at 30 has an inner page 32 containing advertising printing material 33 referring to the cosmetic products contained in the rub-off sample layers of the piece.

The opposite sample containing page 34 has three different cosmetic sample transfer layers 36, 37 and 38. The printing 39 beside each sample specifically describes and refers to that particular sample. These samples, as are those of FIG. 1 are color matched to a particular cosmetic, so that each sample piece gets three distinct color shades, each representing a different cosmetic mentioned in the printing material.

Figure 3:
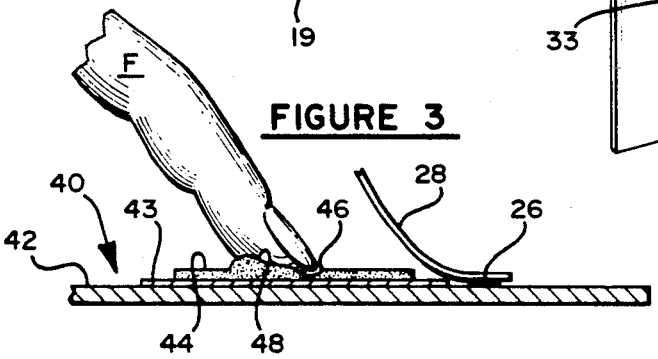
FIG. 3 is an enlarged side sectional view of a sampler showing a sample during the course of its removal.

FIG. 3 is an enlarged view of the flat sheet bind-in sampler, such as that of FIG. 1. It shows a cross-sectional enlarged view of the elements of the piece, and the manner in which the transfer layer of representative cosmetic material is removed by moderate finger pressure. The sample piece generally indicated at 40 is a flat sheet of paper stock 42 on which a barrier layer 43 corresponding to the barrier coatings of FIG. 1 is disposed.

The relatively thick transfer layer 44 is placed directly on top of the barrier layer 43. A barrier layer may not always be required, since the basic sheet or substrate may be sufficiently smooth and non-porous to provide a base for the cosmetic bearing transfer layer. Adhesive line 26, and a portion of the transparent covering strip 28 are shown, the latter in its lifted position to permit removal of the sample sections. Note that on pressure of the finger, a depression 46 is made in the cosmetic bearing transfer layer and it is wiped off the barrier layer. A build up of material accumulates as the finger moves against the transfer layer. The accumulated transfer layer has a soft paste-like consistency, which permits it to be readily spread upon the skin of the user for comparison purposes.

In order to provide such an advertising sample, which can be readily distributed through mass distribution channels or through mail out and return techniques, it is necessary to provide samples on a mass produced basis in which the unit cost for the sampler is kept at a very low unit level.

Figure 4:
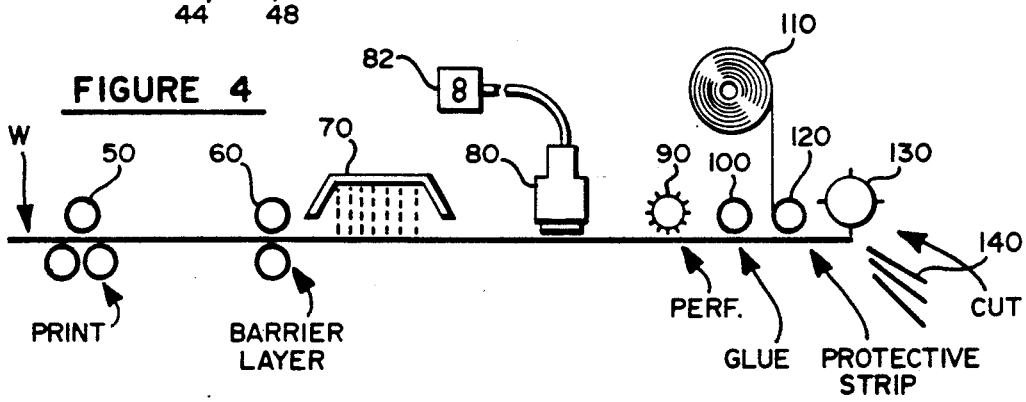
FIG. 4 is a diagrammatic view showing the steps of producing the sampler of FIG. 1.
Figure 5:
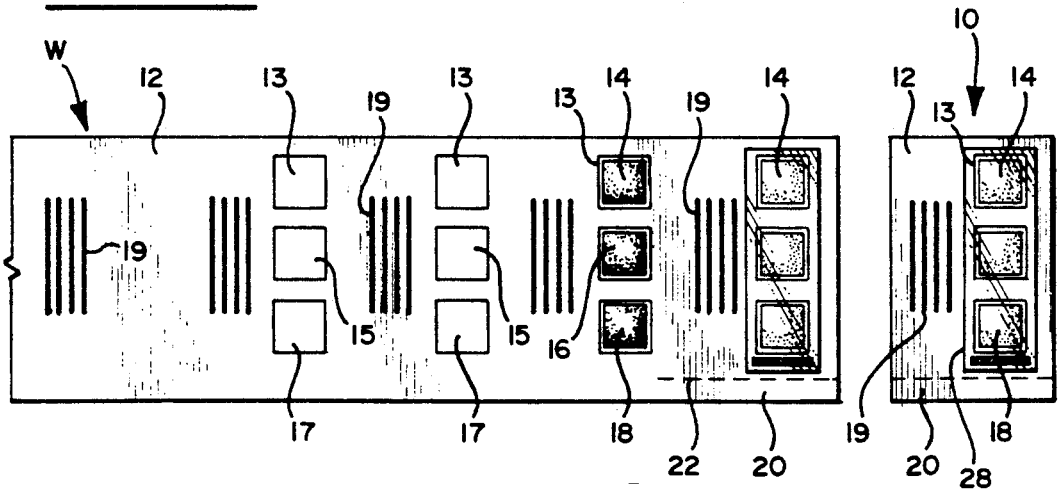
FIG. 5 is a top view of the continuous web from which the sampler of FIG. 1 is manufactured, showing the successive changes at each of the fabrication stages.

FIGS. 4 and 5 respectively illustrate how the manufacture of the sampler piece is accomplished. They illustrate the successive operational stages on the web in FIG. 4, and the successive changes in the web in FIG. 5, as the web moves from the initial printing stage 50 of FIG. 4 to completion of the samplers.

Referring to FIG. 4, it will be seen that the web generally indicated at W is a continuous sheet of stock material such as paper.

Each web of stock is initially printed with the advertising message at the printing stage 50. Following this, the barrier layer is printed on the successive pamphlet pieces. The barrier layer is applied in a liquid state by transfer rolls to the printed web. Preferably, it is an ultra-violet radiated coating applied as a slurry which when dry provides a clear plastic coating that can be either of the water borne or the solvent-borne types. They may be clear plastic acrylate, or a methyl-cellulose.

The barrier layers are dried by exposing them to an ultra-violet mercury arc lamp drying stage 70. The web passes under the lamp at a speed of 200 to 1000 feet per minute. However, the barrier layer is cured almost instaneously, by the ultra-violet radiation.

the cosmetic bearing sample or transfer layer composition is applied to the dried barrier layer, preferably through an extruding nozzle 80 having an elongated slot through which the material is forced. The extruding nozzle is held in light contact with the web. A remote gear pump 82 supplies the sampler a composition to the nozzle through a supply line. The application nozzle has a long ⅜ inch slot that can vary in width from one quarter of an inch to three quarters of an inch.

The sample composition material can also be applied by direct transfer by a flexographic application stage, a direct gravure stage, or a spray stage.

The transfer layer composition itself is a blend of waxes and either high functionality alcohol volatile suspension agents. The coating composition is thick enough so that it will dry quickly and yet leave a relatively thick layer of approximately 4 to 12 thousandths of an inch dry sample or transfer layer.

When the transfer layer composition is applied ti has a very heavy viscous consistency and appears to be in the nature of a heavy waxy oil. When, the resulting dry transfer layer has dried on the sampler it has a cohesiveness and clarity which permits accurate color comparison with the cosmetic product to which it is referenced. A further important quality of the sample or transfer layer is its ability to be readily applied in a mass produced fashion to printed pieces such that it will adhere to the substrate, and also can easily be removed therefrom by moderate finger pressure, as a cohesive readily spreadable substance, and can be immediately applied to the skin.

FIG. 5 shows the web with the successive changes that are made on the web as it progresses through the successive operations shown in FIG. 4.

FIGS. 4 and 5 are shown in registry for illustration purposes. Note that the web W of FIG. 5 shows the printing lines for the bind-in cosmetic rub-off sampler of FIG. 1 aligned with the printed stage 50 of FIG. 4.

Application of the barrier layer sections 13, 15 and 17 are shown after application at the printing stage or the barrier layer. After the barrier layer is dried by the mercury arc drying stage 70, which show no change in the web W of FIG. 5, the transfer coating is applied by nozzle 80 on the barrier layer sections as shown in 14, 16 and 18 of FIG. 5. The web is then perforated by the wheel 90 of FIG. 4, and provides the continuous line 22 of FIG. 5. The completion of the bind-in sampler of FIG. 1 is made by application of the glue line 26 for the protective strip, as shown at 100 in FIG. 4, and, the subsequent application of the clear transparent covering strip 28 from the roll 110 which is placed on the web at 120 of FIG. 4.

The final operation is a transverse cutting of the web at 130 to provide the plurality of individual sampler advertising pieces shown at 140 of FIG. 4, and at the end of the web W at FIG. 5.

The sample containing transfer layer is a blend of material, including the colored cosmetic color matching powder which is the main constituent color material. This is used in the cosmetic applications to give an accurate match for lip stick, blushes, skin cream, eye shadow, and body coloring materials as well as hair coloring.

The important quality of the transfer material is its ability to be removed from the advertising sampler piece by moderate rubbing pressure and then easily reapplied to the surface to which an accurate color match is desired.

The transfer composition provides a good suspension for the coloring material which retains color clarity. It comprises 30 to 50 percent cosmetic powder, 20 to 30 percent high functionality alcohol or polymeric waxes and resins, 2 to 5 percent water, and 2 to 15 percent cellulosic binder. The binder may be a carboxyl methyl cellulose, or an hydroxy methyl cellulose.

After the transfer composition has been applied to the web and dries, it has a relatively hard top surface, and a cake-like property. However, when rubbed off the sampler, it has a heavy paste-like consistency, and is spreadable like heavy cold cream. This is the preferred transfer layer composition property.

It is also possible to employ with the composition, instead of a dry powder, a cosmetic coloring material in micro capsulates.

What I claim is:

1. A rub-off cosmetic advertising sampler produced from a continuous web, comprising:

(a) A flat, printed sheet of paper stock which is one of a series of identical pieces obtained from the web;

(b) the sheet having a transfer layer receiving and rub-off section surface having a smooth, oil-impermeable surface substantially less than the area of the sheet but large enough to accommodate engagement and movement of a finger tip in a rubbing stroke;

(c) a solid relatively thick transfer layer which is a dried residue of a semi-liquid transfer layer composition disposed on the smooth oil impermeable surface of the receiving and rub-off section;

(d) the transfer layer being readily removable from the receiving section by a finger tip on which it accumulates as a uniform cream-like substance readily spreadable on the skin;

(e) the transfer layer, having a high percentage of cosmetic powders, mixed with a binder and waxy oil-like constituents;

(f) the paper sheet having printed matter thereon, referring to the product associated with the transfer layer;

(g) a protective flat covering piece integrally connected with the flat sheet and extending over and covering the transfer layer to protect it during handling; and (h) the covering piece being readily movable from its protective over-lying position to give immediate access to the then un-covered transfer layer surface.

2. The rub-off cosmetic advertising sampler as set forth in claim 1, wherein:

(a) the transfer layer is a blend of cosmetic-like material and a binder which gives an accurate color match to a color hue mentioned in the printed material.

3. The rub-off advertising sampler as set forth in claim 1, wherein:

(a) the transfer layer has a relatively hardened surface, but rubs off under pressure as a soft paste-like cream which can be placed on the skin to give an accurate color match to a commercial cosmetic referred to in the printed material.

4. The rub-off advertising sampler as set forth in claim 2, wherein:

(a) the sheet has a plurality of transfer layer receiving and rub-off sections having different transfer layers representing different cosmetics.

5. The rub-off advertising sampler as set forth in claim 1, wherein:

(a) the sheet contains printed advertising material and is rectangular in shape, and (b) the covering piece is a rectangular sheet hingedly connected along its edge to an edge of the printed sheet.

6. The rub-off advertising sampler as set forth in claim 11, wherein:

(a) the oil-impervious surface being a barrier layer is disposed on the surface of the piece beneath the transfer layer.

7. The rub-off advertising sampler as set forth in claim 6, wherein:

(a) the barrier layer is in an impermeable coating which prevents the paper from absorbing the transfer layer constituents.

8. The rub-off advertising sampler as set forth in claim 6, wherein:

(a) the barrier layer is in ultra-violet radiated coating.

9. The rub-off advertising sampler as set forth in claim 1, wherein:

(a) the cosmetic powder includes cosmetic powder particles of the transfer layers which are approximately 50% by weight thereof.

10. The rub-off advertising sampler as set forth in claim 1, wherein:

(a) an end section of the printed paper sheet is a binding strip separable therefrom along a perforate separation line.

* * * * *

UNITED STATES PATENT AND TRADEMARK OFFICE

CERTIFICATE OF CORRECTION

PATENT NO. : 5,072,831

DATED : December 17, 1991

INVENTOR(S) : Michael A. Parrotta, et. al.

It is certified that error appears in the above-identified patent and that said Letters Patent is hereby corrected as shown below:

After Item [73] insert

[* On the Title Page, the portion of the term of this patent subsquent to August 6, 2008, has been disclaimed.

Signed and Sealed this

Twenty-third Day of June, 1992

*Attest:*

DOUGLAS B. COMER

*Attesting Officer*

*Acting Commissioner of Patents and Trademarks*